US009738956B2

(12) United States Patent
Ikeda et al.

(10) Patent No.: US 9,738,956 B2
(45) Date of Patent: Aug. 22, 2017

(54) ULTRAHIGH-STRENGTH STEEL SHEET WITH EXCELLENT WORKABILITY, AND MANUFACTURING METHOD THEREOF

(75) Inventors: Muneaki Ikeda, Kakogawa (JP); Yukihiro Utsumi, Kakogawa (JP); Masaaki Miura, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 1010 days.

(21) Appl. No.: 13/635,696

(22) PCT Filed: Mar. 25, 2011

(86) PCT No.: PCT/JP2011/057426
§ 371 (c)(1),
(2), (4) Date: Sep. 18, 2012

(87) PCT Pub. No.: WO2011/122487
PCT Pub. Date: Oct. 6, 2011

(65) Prior Publication Data

US 2013/0008570 A1 Jan. 10, 2013

(30) Foreign Application Priority Data

Mar. 29, 2010 (JP) ..... 2010-074399

(51) Int. Cl.

| | |
|---|---|
| ***C22C 38/02*** | (2006.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C21D 6/00*** | (2006.01) |
| ***C21D 8/02*** | (2006.01) |

(52) U.S. Cl.
CPC ..... *C22C 38/02* (2013.01); *C21D 6/005* (2013.01); *C21D 6/008* (2013.01); *C21D 8/02* (2013.01); *C21D 9/46* (2013.01); *C22C 38/001* (2013.01); *C22C 38/04* (2013.01); *C22C 38/06* (2013.01); *C21D 2211/002* (2013.01); *C21D 2211/005* (2013.01); *C21D 2211/008* (2013.01)

(58) Field of Classification Search
CPC ..... C22C 38/001; C22C 38/02; C22C 38/04; C22C 38/06; C21D 6/005; C21D 6/008; C21D 8/02; C21D 9/46; C21D 2211/002; C21D 2211/005; C21D 2211/008
See application file for complete search history.

(56) References Cited

U.S. PATENT DOCUMENTS

| | | | | |
|---|---|---|---|---|
| 7,682,467 | B2 | 3/2010 | Soshiroda et al. | |
| 8,298,356 | B2 | 10/2012 | Ikeda et al. | |
| 2006/0137768 | A1 | 6/2006 | Yuse et al. | |
| 2009/0056836 | A1 | 3/2009 | Watanabe et al. | |
| 2009/0238713 | A1* | 9/2009 | Kinugasa | C21D 1/20 420/83 |
| 2010/0080728 | A1 | 4/2010 | Ikeda et al. | |
| 2010/0247958 | A1 | 9/2010 | Tsunezawa et al. | |
| 2011/0318605 | A1 | 12/2011 | Futamura et al. | |

FOREIGN PATENT DOCUMENTS

| | | |
|---|---|---|
| JP | 2004-359973 A | 12/2004 |
| JP | 2006 207018 | 8/2006 |
| JP | 2007 177271 | 7/2007 |
| JP | 2008 127637 | 6/2008 |
| JP | 4102281 | 6/2008 |
| JP | 2009 149937 | 7/2009 |
| JP | 2010 65272 | 3/2010 |

OTHER PUBLICATIONS

Matsuda et al., English machine translation of JP 2010-065272, Mar. 25, 2010, p. 1-13.*
Futamura et al., English machine translation of JP 2008-127637, Jun. 2008, p. 1-26.*
International Search Report Issued Jun. 28, 2011 in PCT/JP11/57426 Filed Mar. 25, 2011.

* cited by examiner

*Primary Examiner* — Roy King
*Assistant Examiner* — Caitlin Kiechle
(74) *Attorney, Agent, or Firm* — Oblon, McClelland, Maier & Neustadt, L.L.P.

(57) ABSTRACT

Disclosed is an ultra high strength steel plate with at least 1100 MPa of tensile strength that has both an excellent strength-stretch balance and excellent bending workability, and a method for producing the same. The metal structure of the steel plate has martensite, and the soft phases of bainitic ferrite and polygonal ferrite. The area of the aforementioned martensite constitutes 50% or more, the area of the aforementioned bainitic ferrite constitutes 15% or more, and the area of the aforementioned polygonal ferrite constitutes 5% or less (including 0%). When the circle-equivalent diameter of the aforementioned soft phases is measured, the coefficient of variation (standard deviation/mean value) is less or equal to 1.0. The ultra high strength steel plate has at least 1100 MPa of tensile strength.

20 Claims, 2 Drawing Sheets

ULTRAHIGH-STRENGTH STEEL SHEET WITH EXCELLENT WORKABILITY, AND MANUFACTURING METHOD THEREOF

TECHNICAL FIELD

The present invention relates to steel sheets, hot-dip galvanized steel sheets, and hot-dip galvannealed steel sheets each having an ultrahigh strength in terms of tensile strength of 1100 MPa or more; and to methods for manufacturing these steel sheets. More specifically, the present invention relates to a technique for improving workability of the steel sheets.

BACKGROUND ART

High-strength steel sheets are used in wide-ranging uses such as automobiles, transports, household electrical appliances, and building materials. Automobiles and transports, for example, desirably have smaller weights for lower fuel consumption. Among them, automobiles require collision safety, and structural parts such as pillars, and reinforcing parts such as bumpers and impact beams for use in the automobiles should have higher strengths. Of these, members requiring rust prevention also employ hot-dip galvanized steel sheets (hereinafter also referred to as GI steel sheets) and hot-dip galvannealed steel sheets (hereinafter also referred to as GA steel sheets) because of excellent rust prevention of the GI steel sheets and GA steel sheets. The GA steel sheets are manufactured by subjecting GI steel sheets to an alloying treatment. A steel sheet, when designed to have a higher strength, may have inferior elongation (ductility) and thereby have poor workability. To prevent the deterioration in workability, the aforementioned steel sheets require good balance between strength and elongation and also require good bending workability without cracking upon working.

Patent literature (PTL) 1, PTL 2, PTL 3, and PTL 4 disclose techniques for improving the workability (strength-elongation balance and bending workability) of high-strength steel sheets. Of these, PTL 1 discloses a high-strength GI steel sheet having a tensile strength of 780 MPa or more and having improved bore expandability and bendability, in which the steel sheet has a metal structure including 50% or more of a ferrite phase and 10% or more of a martensite phase, the ferrite phase includes a bainitic ferrite phase in an amount of from 20 to 80 percent by area, and the martensite phase has an average grain size of 10 μm or less. Specifically, the steel sheet contains a highly ductile and soft ferrite phase in an amount of 50 percent by area or more to ensure satisfactory ductility, and contains chromium (Cr) in a large amount to increase the amount of martensite as a second phase to thereby ensure a satisfactory strength.

PTL 2 discloses cold-rolled thin steel sheet which includes 50 to 90 percent by volume of a martensite phase, 5 to 35 percent by volume of a hard bainite phase, 35 percent by volume or less of a soft bainite phase, and 0.1 to 5 percent by volume of retained austenite, has a tensile strength of 1100 MPa or more, and has a bore expansion ratio of 40% or more. The cold-rolled thin steel sheet, however, probably fails to have both pod strength-elongation balance and satisfactory bendability, because the steel sheet has a low elongation because of the presence of the hard bainite phase. In addition, the cold-rolled thin steel sheet requires production facilities to perform slow cooling and rapid cooling in combination so as to obtain the hard bainite phase, resulting in high cost.

PTL 3 discloses a high-strength steel sheet exhibiting excellent formability and having a tensile strength of 980 MPa or more. This high-strength steel sheet is designed to have a higher strength by utilizing a martensite structure, to contain carbon (C) in a content of 0.16% or more, and to utilize transformation of upper bainite. The steel sheet therefore includes a sufficient amount (specifically 5% or more and 50% or less) of retained austenite which is stable and is advantageous for obtaining transformation induced plasticity (TRIP) effects.

PTL 4 discloses a high-strength steel sheet having a tensile strength of 800 MPa or more and exhibiting satisfactory bore expandability, as a steel sheet containing niobium (Nb) and molybdenum (Mo) in combination and having a specific metal structure. The metal structure contains a total of 70% or more of one or more phases selected from bainite, bainitic ferrite, and a martensite having a carbon content of less than 0.1% or having a Vickers hardness of 450 or less and contains, if any, retained austenite in a controlled amount of less than 3%.

CITATION LIST

Patent Literature

PTL 1: Japanese Unexamined Patent Application Publication (JP-A) No. 2009-149937
PTL 2: JP-A No. 2007-177271
PTL 3: JP-A No. 2010-65272
PTL 4: Japanese Patent No. 4102281

SUMMARY OF INVENTION

Technical Problem

The high-strength steel sheets recently require higher and higher strengths and require "ultrahigh strengths" as tensile strengths of 1100 MPa or more. However, the steel sheets, if designed to have ultrahigh strengths, may exhibit further inferior elongation and may thereby have further deteriorated strength-elongation balance and further inferior workability. The steel sheets having ultrahigh strengths also exhibit inferior bending workability, resulting in further inferior workability.

The present invention has been made while focusing these circumstances, and an object thereof is to provide an ultrahigh-strength steel sheet having a tensile strength of 1100 MPa or more, which excels both in strength-elongation balance and bending workability; and to provide a method for manufacturing the ultrahigh-strength steel sheet.

Solution to Problem

The present invention has achieved the object and provides an ultrahigh-strength steel sheet with excellent workability, which contains carbon (C) in a content of from 0.05% to 0.25% ("percent" means "percent by mass", hereinafter the same is true for chemical compositions), silicon (Si) in a content of from 0.5% to 2.5%, manganese (Mn) in a content of from 2.0% to 4%, phosphorus (P) in a content of 0.1% or less (excluding 0%), sulfur (S) in a content of 0.05% or less (exduding 0%), aluminum (Al) in a content of from 0.01% to 0.1%, and nitrogen (N) in a content of 0.01% or less (excluding 0%), with the remainder including iron and inevitable impurities. The steel sheet has a metal structure including martensite and a soft phase including bainitic ferrite and, if any, polygonal ferrite, and the metal structure contains 50 percent by area or more of the martensite, 15 percent by area or more of the bainitic ferrite, and 5 percent by area or less (including 0 percent by area) of the polygonal ferrite, each relative to the entire metal structure. The steel sheet has a coefficient of variation [(standard deviation)/(arithmetic mean)] in equivalent circle diameters of grains of the soft phase of 1.0 or less, and has a tensile strength of 1100 MPa or more.

The steel sheet may further contain, as an additional element, one or more of the following groups (a) to (e):

(a) at least one element selected from the group consisting of titanium (Ti) in a content of 0.10% or less (excluding 0%), niobium (Nb) in a content of 0.2% or less (excluding 0%), and vanadium (V) in a content of 0.2% or less (excluding 0%);

(b) at least one element selected from the group consisting of chromium (Cr) in a content of 1% or less (excluding 0%), copper (Cu) in a content of 1% or less (excluding 0%), and nickel (Ni) in a content of 1% or less (excluding 0%);

(c) molybdenum (Mo) in a content of 1% or less (excluding 0%) and/or tungsten (W) in a content of 1% or less (excluding 0%);

(d) boron (B) in a content of 0.005% or less (excluding 0%); and (e) at least one element selected from the group consisting of calcium (Ca) in a content of 0.005% or less (excluding 0%), magnesium (Mg) in a content of 0.005% or less (excluding 0%), and one or more rare earth elements (REMs) in a content of 0.005% or less (excluding 0%).

The present invention also includes an ultrahigh-strength hot-dip galvanized steel sheet including the ultrahigh-strength steel sheet and, on a surface thereof, a hot-dip galvanized layer. The ultrahigh-strength hot-dip galvanized steel sheet has excellent workability. The present invention further includes an ultrahigh-strength hot-dip galvannealed steel sheet obtained by subjecting the ultrahigh-strength hot-dip galvanized steel sheet to an alloying treatment. The ultrahigh-strength hot-dip galvannealed steel sheet has excellent workability.

The ultrahigh-strength steel sheet according to the present invention may be manufactured by cold-rolling a hot-rolled steel sheet to a cold-rolling reduction CR (%) satisfying following Expression (1), the hot-rolled steel sheet having a chemical composition as defined above; soaking the steel sheet after cold rolling at a temperature in the range of from a temperature lower than the $Ac_3$ point by 10° C. to a temperature higher than the $Ac_3$ point by 50° C.; and cooling the soaked steel sheet down to a cooling stop temperature of 550° C. or lower and 450° C. or higher. The ultrahigh-strength steel sheet obtained by the manufacturing method may further be subjected to hot-dip galvanization to give the ultrahigh-strength hot-dip galvanized steel sheet according to the present invention. The ultrahigh-strength steel sheet after the hot-dip galvanization may further be subjected to an alloying treatment to give the ultrahigh-strength hot-dip galvannealed steel sheet. In following Expression (1), symbols in brackets represent the contents (percent by mass) of the respective elements:

$$0.4\times CR-400\times[Ti]-250\times[Nb]-150\times[V]+10\times[Si]-10\times[Mn]+10\geq 0 \quad (1)$$

Advantageous Effects of Invention

A steel sheet according to the present invention has a metal structure which mainly includes martensite and further includes, as a soft phase, bainitic ferrite and, if any, polygonal ferrite, in which the bainitic ferrite is contained in a specific amount or more, and the polygonal ferrite is contained in a specific amount or less in the soft phase, and grains of the soft phase have equivalent circle diameters with a smaller variation. This provides an ultrahigh-strength steel sheet, an ultrahigh-strength GI steel sheet, and an ultrahigh-strength GA steel sheet each of which has an ultrahigh strength of 1100 MPa or more and excels in workability (strength-elongation balance and bending workability).

DESCRIPTION OF EMBODIMENTS

Figure 1:
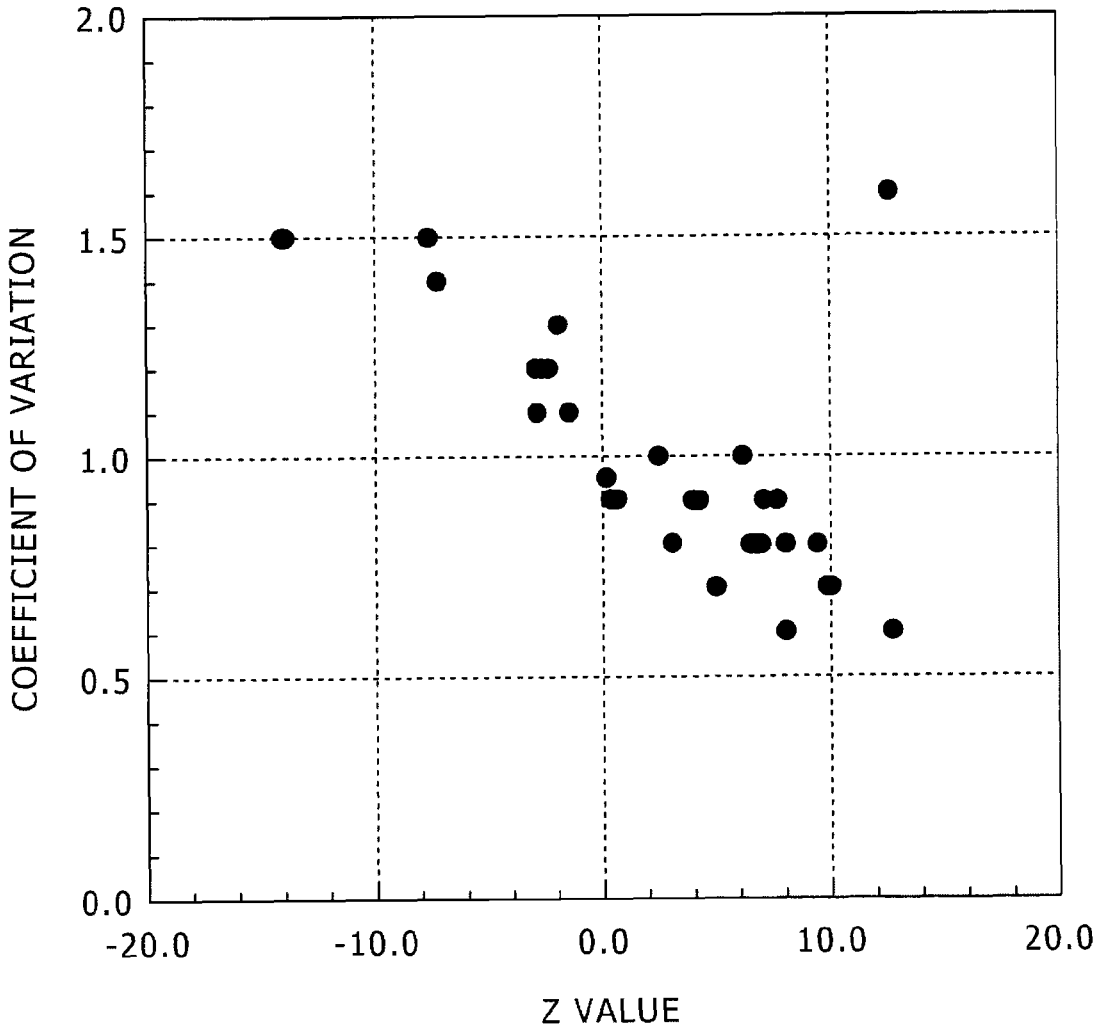
FIG. 1 is a graph illustrating how the coefficient of variation in equivalent circle diameters of grains of soft phase varies depending on the left-side value (Z value) of Expression (1).

The present inventors made intensive investigations focusing particularly on metal structures to improve workability (strength-elongation balance and bending workability) of ultrahigh-strength steel sheets, ultrahigh-strength GI steel sheets, and ultrahigh-strength GA steel sheets each having a tensile strength of 1100 MPa or more. As a result, the present inventors have found that these steel sheets can have dramatically improved workability at such ultrahigh strengths by designing their metal structure as follows. Specifically, the metal structure mainly contains martensite so as to have a tensile strength of 1100 MPa or more, further contains, as a second phase, a soft phase including bainitic ferrite and, if any, polygonal ferrite, in which the formation of polygonal ferrite is suppressed and the formation of bainitic ferrite is enhanced, and grain sizes of the soft phase are suitably controlled in variation (coefficient of variation). The present invention has been made based on these findings. The present inventors have found that, of these factors, the coefficient of variation in size of the soft phase is very important factor to provide desired properties; and that, if a steel sheet has a coefficient of variation out of the range specified in the present invention, the steel sheet has a poor strength-elongation balance and poor bending workability (particularly bending workability) at an ultrahigh strength, even when the steel sheet has fractions of respective components in the metal structure falling within the ranges (see working examples mentioned later).

Initially, what leading up to the present invention will be described.

The present inventors designed the metal structure of a steel sheet to mainly contain martensite (specifically, in a content of 50 percent by area or more relative to the entire metal structure), to contain polygonal ferrite in a smaller amount (specifically, in a content of 5 percent by area or less relative to the entire metal structure), and to positively contain bainitic ferrite (specifically, in a content of 15 percent by area or more relative to the entire metal structure), which bainitic ferrite is harder than polygonal ferrite and has an elongation higher than that of martensite. This was performed to allow the steel sheet to have a tensile strength of 1100 MPa or more, not to suffer from cracking upon bending, and to have a better strength-elongation balance. The present inventors, however, found that some steel sheets suffer from cracking upon bending or have a still insufficient strength-elongation balance even when their metal structures are controlled in the above manner.

After further investigations, the present inventors have found that the variation in size of the polygonal ferrite and the bainitic ferrite (hereinafter also generically referred to as "soft phase") significantly affects the cracking upon bending and the strength-elongation balance. The variation in size is evaluated herein at coefficient of variation in equivalent circle diameter. Specifically, the present inventors have found that, when equivalent circle diameters of grains of the soft phase are measured multiple times, a steel sheet having a certain variation in measured equivalent circle diameters often suffers from cracking upon bending and has an inferior strength-elongation balance even having an identical arithmetic mean of equivalent circle diameters in multiple measurements. This is probably because the steel sheet having a variation in measured equivalent circle diameters receives stress ununiformly upon bending, where the stress focuses on grains of the soft phase having large equivalent circle diameters, and the steel sheet also suffers from variation in strength and elongation due to unevenness in size of the soft phase.

Next, an ultrahigh-strength steel sheet according to an embodiment of the present invention will be illustrated in detail below.

The ultrahigh-strength steel sheet according to the present invention has a metal structure including martensite and, as a soft phase, bainitic ferrite and, if any, polygonal ferrite. Specifically, the metal structure includes martensite in a content of 50 percent by area or more, bainitic ferrite in a content of 15 percent by area or more, and polygonal ferrite in a controlled content of 5 percent by area or less, each relative to the entire metal structure. Most distinctively, the ultrahigh-strength steel sheet has a coefficient of variation in equivalent circle diameters being controlled to 1.0 or less. The coefficient of variation is an index for variation in equivalent circle diameter. The term "coefficient of variation" as used herein refers to a value [(standard deviation)/(arithmetic mean)] determined by dividing a standard deviation (obtained from the measured equivalent circle diameters) by an arithmetic mean of the measured equivalent circle diameters.

The main phase martensite structure is necessary for allowing the steel sheet to have a tensile strength of 1100 MPa or more. Martensite, if contained in a content of less than 50 percent by area relative to the entire metal structure, may not contribute to a sufficient strength. To avoid this, martensite is contain in a content of 50 percent by area or more, preferably 60 percent by area or more, and more preferably 70 percent by area or more. The metal structure may contain martensite in a content of up to 85 percent by area in terms of upper limit, so as to contain after-mentioned bainitic ferrite in a sufficient amount. A steel sheet containing martensite in an excessively large amount may have an insufficient elongation thereby have a poor strength-elongation balance to exhibit inferior workability. To avoid this, the metal structure contains martensite in a content of more preferably 80 percent by area or less.

The soft phase as a second phase includes bainitic ferrite and, if any, polygonal ferrite, and these structures are contained in a total content of less than 50 percent by area relative to the entire metal structure. The metal structure may contain 0 percent by area of polygonal ferrite (i.e., it is acceptable that the metal structure contains no polygonal ferrite).

The bainitic ferrite structure helps the steel sheet to have a higher elongation and to have a better strength-elongation balance, thus contributing to better workability. The bainitic ferrite is harder than the polygonal ferrite. The steel sheet, when containing polygonal ferrite in a smaller amount and positively containing bainitic ferrite in a larger amount, can have a small difference in hardness between ferrite and martensite to exhibit better bending workability. For these reasons, the bainitic ferrite content is 15 percent by area or more, preferably 20 percent by area or more, and more preferably 25 percent by area or more, relative to the entire metal structure. The metal structure preferably contains bainitic ferrite in a content of less than 50 percent by area to contain a sufficient amount of the martensite fraction (martensite structure). Bainitic ferrite, if present in an excessively high content, may adversely affect the strength To avoid this, the bainitic ferrite content is more preferably 45 percent by area or less, and furthermore preferably 40 percent by area or less.

The polygonal ferrite should be controlled in content to 5 percent by area or less relative to the entire metal structure. The polygonal ferrite content is preferably 4 percent by area or less, more preferably 3 percent by area or less, and most preferably 0 percent by area.

As used herein the term "bainitic ferrite" refers to a substructure having a high dislocation density; and the term "polygonal ferrite" refers to a substructure which is equiaxial ferrite, and which exhibits no dislocation or has an extremely low dislocation density. The bainitic ferrite and the polygonal ferrite can be dearly distinguished by observation under a scanning electron microscope (SEM) as is described below.

The area percentages of the bainitic ferrite and the polygonal ferrite can be determined in the following manner. Specifically, the steel sheet is cut into a sample so as to observe a cross-section at a position of one-fourth the thickness of the steel sheet, the sample is etched with a Nital solution, and a measurement region (about 20 μm by about 20 μm) at an arbitrary site in the cross-section is observed under a SEM at a 4000-fold magnification. Bainitic ferrite appears dark gray, whereas polygonal ferrite appears black in a scanning electron micrograph. Polygonal ferrite is equiaxial and does not contain retained austenite and martensite inside.

The coefficient of variation in equivalent circle diameters of grains of the soft phase (second phase) is herein distinctively controlled to 1.0 or less. A steel sheet having a coefficient of variation in equivalent circle diameters of more than 1.0 suffers from uneven grain sizes of the soft phase and thereby suffers from poor bending workability and/or an inferior strength-elongation balance. The coefficient of variation is preferably minimized, and may be controlled to 1.0 or less, preferably 0.9 or less, and more preferably 0.8 or less.

The equivalent circle diameters of grains of the soft phase are measured by observing the cross section of the steel sheet at a position of one-fourth the thickness of the steel sheet under a SEM in at least three view fields and measuring equivalent circle diameters of all the soft phases (bainitic ferrite and polygonal ferrite) present in the observed view fields. As used herein the term "equivalent circle diameter" refers to a diameter of an assumed circle having an area equal to that of a soft phase and serves as an index for the size of the soft phase. A standard deviation and an arithmetic mean of the measured equivalent circle diameters are determined, and the standard deviation is divided by the arithmetic mean to give a coefficient of variation [(standard deviation)/(arithmetic mean)].

The soft phase preferably has equivalent circle diameters with a standard deviation of from 0.7 to 1.4 and an arithmetic mean of from 1.1 to 1.7 μm. The soft phase preferably has equivalent circle diameters with a minimum of 0.05 μm or more and a maximum of 3.3 μm or less.

The metal structure of the ultrahigh-strength steel sheet according to the present invention has only to include martensite as a main-phase (matrix) and soft phases (bainitic ferrite and polygonal ferrite) as a second phase and may further include any of other metal structures (e.g., pearlite, bainite, and retained austenite) within a range not adversely affecting the operation and advantageous effects of the present invention. The total content of such other metal structures may be controlled to preferably 5 percent by area or less, more preferably 4 percent by area or less, and furthermore preferably 3 percent by area or less.

The ultrahigh-strength steel sheet according to the present invention should have a metal structure satisfying the conditions and have a chemical composition of: carbon (C) in a content of from 0.05% to 0.25%, silicon (Si) in a content of from 0.5% to 2.5%, manganese (Mn) in a content of from 2.0% to 4%, phosphorus (P) in a content of 0.1% or less (excluding 0%), sulfur (S) in a content of 0.05% or less (excluding 0%), aluminum (Al) in a content of from 0.01% to 0.1%, and nitrogen (N) in a content of 0.01% or less (excluding 0%). These ranges are specified for the following reasons.

Carbon (C) element is essential for better hardenability and higher hardness of martensite to allow the steel to have a sufficient strength. For this reason, the carbon content may be 0.05% or more, preferably 0.1% or more, and more preferably 0.13% or more. However, carbon, if present in a content of more than 0.25%, may cause the steel to have an excessively high strength to thereby have an insufficient elongation, thus failing to improve the balance between strength and elongation and failing to improve the workability. To avoid these, the carbon content may be 0.25% or less, preferably 0.2% or less, and more preferably 0.18% or less.

Silicon (Si) element exhibits solid-solution strengthening and thereby helps the steel to have a higher strength without impairing the elongation. The silicon element suppresses the formation of cementite which causes cracking. The silicon element, in addition, elevates the $Ac_1$ point, widens the range of recrystallization temperatures to effectively accelerate recrystallization, and contributes to reduction in the coefficient of variation. For these reasons, the Si content may be 0.5% or more, preferably 0.75% or more, and more preferably 1% or more. Silicon, if present in a content of more than 2.5%, may adversely affect platability of the steel sheet. To avoid this, the Si content may be 2.5% or less, preferably 2% or less, and more preferably 1.8% or less.

Manganese (Mn) element is necessary for higher hardenability and for a sufficient strength. For these reasons, the Mn content may be 2.0% or more, preferably 2.3% or more, and more preferably 2.5% or more. However, the manganese element lowers the $Ac_1$ point to narrow the range of recrystallization temperatures as described later, and adversely affects the recrystallization to cause the steel sheet to have a larger coefficient of variation. The manganese element, if present in excess, may adversely affect the platability and may segregate to cause the steel sheet to have an insufficient strength. The manganese element may promote the segregation of phosphorus at grain boundaries to cause intergranular embrittlement. To avoid these, the Mn content may be 4% or less, preferably 3.5% or less, and more preferably 3% or less.

Phosphorus (P) element segregates at grain boundaries to cause intergranular embrittlement. To avoid this, the phosphorus content may be 0.1% or less, preferably 0.03% or less, and more preferably 0.015% or less.

Sulfur (S) forms large amounts of sulfide inclusions (e.g., MnS) that cause cracking to impair the workability (particularly, bending workability). To avoid these, the sulfur content may be 0.05% or less, preferably 0.01% or less, and more preferably 0.008% or less.

Aluminum (Al) element serves as a deoxidizes; and, to exhibit this effect, aluminum is contained in a content of 0.01% or more, preferably 0.02% or more, and more preferably 0.03% or more. However, aluminum, if contained in excess, may form Al-containing inclusions (e.g., oxides such as alumina) to cause the steel to have insufficient toughness and workability. To avoid these, aluminum may be contained in a content of 0.1% or less, preferably 0.08% or less, and more preferably 0.05% or less.

Nitrogen (N) element is inevitably contained in the steel, but, if contained in excess, may cause the steel to have insufficient workability. When the steel contains boron (B), nitrogen may precipitate as boron nitride (BN) to thereby impede hardenability improvement by the action of boron. To avoid these, nitrogen is desirably minimized, and the nitrogen content may be 0.01% or less, preferably 0.008% or less, and more preferably 0.005% or less.

The ultrahigh-strength steel sheet according to the present invention has a basic chemical composition as described above, with the remainder including iron and inevitable impurities.

The ultrahigh-strength steel sheet according to the present invention may further contain, as an additional element or elements, any of groups (a) to (e) below.

[(a) At least one element selected from the group consisting of titanium (Ti) in a content of 0.10% or less (excluding 0%), niobium (Nb) in a content of 0.2% or less (excluding 0%), and vanadium (V) in a content of 0.2% or less (excluding 0%)]

Titanium (Ti), niobium (Nb), and vanadium (V) elements improve hardenability, allow the steel sheet to have a smaller size of the metal structure to thereby have a higher strength. These elements, however, elevate the recrystallization start temperature to narrow the range of recrystallization temperatures, thus increasing the coefficient of variation. Each of these elements may be added alone or in combination. These elements, if contained in excess, may cause the steel sheet to have a larger coefficient of variation and to have insufficient workability. To avoid these, the Ti content is preferably 0.10% or less, more preferably 0.09% or less, and furthermore preferably 0.08% or less; the Nb content is preferably 0.2% or less, more preferably 0.15% or less, and furthermore preferably 0.1% or less; and the vanadium content is preferably 0.2% or less, more preferably 0.15% or less, and furthermore preferably 0.1% or less. Titanium may be contained in a content of preferably 0.01% or more, more preferably 0.02% or more, and furthermore preferably 0.03% or more. Niobium may be contained in a content of preferably 0.01% or more, more preferably 0.02% or more, and furthermore preferably 0.03% or more. Vanadium may be contained in a content of preferably 0.01% or more.

[(b) At least one element selected from the group consisting of chromium (Cr) in a content of 1% or less (excluding 0%), copper (Cu) in a content of 1% or less (excluding 0%), and nickel (Ni) in a content of 1% or less (excluding 0%)]

Chromium (Cr), copper (Cu), and nickel (Ni) elements each help the steel sheet to have a higher strength. Each of these elements may be added alone or in combination.

Chromium (Cr) element suppresses the formation and growth of cementite and helps the steel sheet to have better bending workability. Chromium, if contained in excess, may form a large amount of chromium carbide to impair the workability and may cause the steel sheet to have inferior platability. To avoid these, the Cr content is preferably 1% or less, more preferably 0.7% or less, and furthermore preferably 0.4% or less. Chromium may be contained in a content of preferably 0.01% or more, more preferably 0.02% or more, and furthermore preferably 0.05% or more.

Copper (Cu) and nickel (Ni) element both help the steel sheet to have better corrosion resistance. However, these elements, if contained in excess, may cause the steel sheet to have insufficient hot workability. To avoid this, the Cu content is preferably 1% or less, more preferably 0.8% or less, and furthermore preferably 0.5% or less; and the Ni content is preferably 1% or less, more preferably 0.8% or less, and furthermore preferably 0.5% or less. Copper may be contained in a content of preferably 0.01% or more, more preferably 0.05% or more, and furthermore preferably 0.1% or more. Nickel may be contained in a content of 0.01% or more, more preferably 0.05% or more, and furthermore preferably 0.1% or more.

[(c) Molybdenum (Mo) in a content of 1% or less (exduding 0%) and/or tungsten (W) in a content of 1% or less (excluding 0%)]

Molybdenum (Mo) and tungsten (W) elements both help the steel sheet to have a higher strength Each of these elements may be added alone or in combination. However, molybdenum, if contained in excess, may exhibit saturated effects and may cause high cost. To avoid these, the Mo content is preferably 1% or less, more preferably 0.5% or less, and furthermore preferably 0.3% or less. Tungsten, if contained in excess, may cause the steel sheet to have an insufficient elongation to thereby have inferior workability. To avoid these, the tungsten content is preferably 1% or less, more preferably 0.5% or less, and furthermore preferably 0.3% or less. Molybdenum may be contained in a content of preferably 0.01% or more, more preferably 0.03% or more, and furthermore preferably 0.05% or more. Tungsten may be contained in a content of preferably 0.01% or more, more preferably 0.02% or more, and furthermore preferably 0.03% or more.

[(d) Boron (B) in a content of 0.005% or less (excluding 0%)]

Boron (B) element improves hardenability and thereby helps the steel sheet to have a higher strength. However, boron, if contained in excess, may cause the steel sheet to have insufficient hot workability. To avoid this, the boron content is preferably 0.005% or less, more preferably 0.003% or less, and furthermore preferably 0.001% or less. Boron may be contained in a content of preferably 0.0002% or more, more preferably 0.0003% or more, and furthermore preferably 0.0005% or more.

[(e) At Least one element selected from the group consisting of calcium (Ca) in a content of 0.005% or less (excluding 0%), magnesium (Mg) in a content of 0.005% or less (excluding 0%), and one or more rare-earth elements (REMs) in a content of 0.005% or less (excluding 0%)]

Calcium (Ca) element, magnesium (Mg) element, and rare-earth element(s) (REM) each control the morphology of inclusions in the steel, allow the inclusions to be finely dispersed, and thus contribute to better workability. Each of these elements may be added alone or in combination. However, these elements, if contained in excess, may adversely affect the workability contrarily. To avoid this, the Ca content is preferably 0.005% or less, more preferably 0.004% or less, and furthermore preferably 0.003% or less; the Mg content is preferably 0.005% or less, more preferably 0.004% or less, and furthermore preferably 0.003% or less; and the REM content is preferably 0.005% or less, more preferably 0.003% or less, and furthermore preferably 0.001% or less. Calcium may be contained in a content of preferably 0.0005% or more, more preferably 0.0007% or more, and furthermore preferably 0.0009% or more. Magnesium may be contained in a content of preferably 0.0005% or more, more preferably 0.001% or more, and furthermore preferably 0.0015% or more. One or more REMs may be contained in a content of preferably 0.0001% or more, more preferably 0.00013% or more, and furthermore preferably 0.00015% or more.

As used herein the term "REM (rare-earth element)" refers to and includes lanthanoid elements as well as Sc (scandium) and Y (yttrium), in which the lanthanoid elements include a total of fifteen elements ranging from La (atomic number 57) to Lu (atomic number 71) in the periodic table of elements. Of these REMs, the steel sheet preferably contains at least one element selected from the group consisting of La, Ce and Y, and more preferably contains La and/or Ce.

The ultrahigh-strength steel sheet according to the present invention has been illustrated above.

The ultrahigh-strength steel sheet may have a hot-dip galvanized layer on its surface to serve as an ultrahigh-strength GI steel sheet. The hot-dip galvanized layer of the GI steel sheet may be alloyed. Specifically, the present invention also includes an ultrahigh-strength GA steel sheet which is obtained by subjecting the ultrahigh-strength GI steel sheet to an alloying treatment.

Next, a method for manufacturing the ultrahigh-strength steel sheet according to the present invention will be illustrated.

Suitable control of cold rolling conditions, soaking conditions, and post-soaking cooling conditions is important for the metal structure to mainly contain martensite and to contain, as a second phase serving as a soft phase, bainitic ferrite and polygonal ferrite in amounts with a suitably controlled balance between them, and to contain grains of the soft phase having equivalent circle diameters as with a coefficient of variation controlled within a predetermined range. Specifically, a hot-rolled steel sheet having a chemical composition satisfying the above conditions is cold rolled to a cold-rolling reduction CR (%) satisfying following Expression (1) and raised in temperature to a temperature around the $Ac_3$ point (specifically, from a temperature lower than the $Ac_3$ point by 10° C. to a temperature higher than the $Ac_3$ point by 50° C.) so as to perform recrystallization sufficiently during this temperature rise process, to control the coefficient of variation in equivalent circle diameters of grains of the soft phase at the specific level or less. In following Expression (1), symbols in brackets represent the contents (percent by mass) of the respective elements.

$$0.4\times CR-400\times[Ti]-250\times[Nb]-150\times[V]+10\times[Si]-10\times[Mn]+10\geq 0 \quad (1)$$

Next, the steel sheet is soaked at the temperature around the $Ac_3$ point to suppress the formation of polygonal ferrite and to accelerate the formation of martensite. The steel sheet is then cooled to form bainitic ferrite. Specifically, the cooling is performed down to a cooling stop temperature of 550° C. or lower and 450° C. or higher.

The method for manufacturing the ultrahigh-strength steel sheet according to the present invention will be described in detail below.

Initially, a hot-rolled steel sheet having the chemical composition is prepared. The hot rolling may be performed according to a common procedure. The heating temperature herein is preferably from about 1150° C. to 1300° C. to ensure a finish temperature and to prevent austenite grains from being coarse. Finish rolling is preferably performed at a temperature of from 850° C. to 950° C. so as to avoid the formation of an aggregate structure which adversely affects the workability. The steel sheet may be coiled thereafter.

Where necessary, the steel sheet after the hot rolling may be subjected to acid-washed according to a common procedure before cold rolling. The cold rolling is performed so that the cold-rolling reduction CR satisfies Expression (1).

Expression (1) is specified under the concept that sufficient recrystallization during heating is effective to reduce size variation of the soft phase. The degree of recrystallization is considered to have a correlation with the range of recrystallization temperatures from the recrystallization start temperature to the $Ac_1$ point. A wider range of recrystallization temperatures therefore reduces the size variation of the soft phase and helps the steel sheet to ultimately have desired bending workability and strength-elongation balance. The present inventors selected the cold-rolling reduction CR, Ti, Nb, and V as factors affecting the recrystallization start temperature, and Si and Mn as factors affecting the $Ac_1$ point; and intensively made many fundamental experiments about how much the respective factors contribute to the range of recrystallization temperatures and how the factors affect the size variation of grains of the soft phase. As a result, they successfully introduced the degree Z of the range of recrystallization temperatures.

Suitable control of the cold-rolling reduction CR in relation with the contents of the respective compositions (elements) as indicated in Expression (1) sufficiently broadens the range of recrystallization temperatures, and this reduces the size variation of grains of the soft phase.

Among these factors, the cold-rolling reduction CR and Si are positive factors to broaden the range of recrystallization temperatures. Specifically, when cold rolling is performed to a larger cold-rolling reduction CR, a larger amount of strain is introduced, and this lowers the recrystallization start temperature to broaden the range of recrystallization temperatures. Silicon helps to form ferrite, elevates the $Ac_1$ temperature, and broadens the range of recrystallization temperatures.

Unlike the above factors, Ti, Nb, V, and Mn are negative factors that narrow the range of recrystallization temperatures. Specifically, Ti, Nb, and V form carbonitrides which suppress the growth of recrystallized grains, and thereby elevate the recrystallization start temperature to narrow the range of recrystallization temperatures. Mn serves as an austenite-forming element and thereby lowers the $Ac_1$ temperature to narrow the range of recrystallization temperatures.

The positivity (being 0 or more) of the left-hand value in Expression (1) (this value is hereinafter also referred to as Z value) indicates that the range of recrystallization temperatures is broad, and sufficient recrystallization occurs during the temperature rise process to reduce the coefficient of variation.

Ti, Nb, and V are not essential elements, and, when the steel sheet does not contain any of these elements, the Z value may be calculated by substituting "0 percent by mass" into a corresponding space in Expression (1).

After the cold rolling, the steel sheet is soaked by heating to and holding at a temperature in the range of from a temperature lower than the $Ac_3$ point by 10° C. to a temperature higher than the $Ac_3$ point by 50° C. This suppresses the formation of polygonal ferrite and accelerates the formation of martensite. Soaking, if performed at a temperature lower than the $Ac_3$ point by more than 10° C., may cause the formation of polygonal ferrite in a large amount and may suppress the formation of martensite, and the resulting steel sheet may fail to have a sufficiently high strength. To avoid these, the soaking temperature may be equal to or higher than a temperature which is lower by 10° C. than the $Ac_3$ point, preferably equal to or higher than a temperature which is lower by 5° C. than the $Ac_3$ point, and more preferably equal to or higher than the $Ac_3$ point. In contrast, soaking, if performed at a temperature higher than the $Ac_3$ point by more than 50° C., may cause coarse austenite grains to adversely affect the workability. To avoid these, the soaking temperature may be equal to or lower than a temperature which is higher than the $Ac_3$ point by 50° C., preferably equal to or lower than a temperature which is higher than the $Ac_3$ point by 40° C., and more preferably equal to or lower than a temperature which is higher than the $Ac_3$ point by 30° C.

The holding time in soaking is not critical and may be from about 10 to about 100 seconds, and preferably from about 10 to about 80 seconds.

The $Ac_3$ point is a temperature at which the structure completes change from ferrite upon heating and is calculated according to following Expression (i), wherein symbols in brackets represent the contents (percent by mass) of respective elements. This expression is described in "The Physical Metallurgy of Steels", William C. Leslie (Japanese translation, p. 273, Maruzen Co., Ltd.).

$$Ac_3(^\circ C.)=910-203\times[C]^{1/2}-15.2\times[Ni]+44.7\times[Si]+104\times[V]+31.5\times[Mo]+13.1\times[W]-\{30\times[Mn]+11\times[Cr]+20\times[Cu]-700\times[P]-400\times[Al]-120\times[As]-400\times[Ti]\} \quad (i)$$

After the soaking, the steel sheet is cooled down to a cooling stop temperature of from 550° C. or lower and 450° C. or higher to form bainitic ferrite. Cooling, if performed to a cooling stop temperature of higher than 550° C., may lead to a smaller amount of formed bainitic ferrite, and this may cause the steel sheet to have inferior bending workability and strength-elongation balance. To avoid this, the cooling stop temperature may be 550° C. or lower, preferably 540° C. or lower, and more preferably 530° C. or lower. In contrast, cooling, if performed to a cooling stop temperature of lower than 450° C., may cause an excessively large amount of bainitic ferrite, and this may impede the formation of martensite, resulting in an insufficient strength. To avoid this, the cooling stop temperature may be 450° C. or higher, preferably 460° C. or higher, and more preferably 470° C. or higher.

The average cooling rate in cooling from the soaking temperature to the cooling stop temperature may typically be 1° C./second or more to prevent the formation of pearlite and other undesirable structures. Cooling, if performed at an average cooling rate of less than 1° C./second, may cause the formation of pearlite structure, and this may remain as a final structure to impair the elongation. The average cooling rate is preferably 5° C./second or more. Though not critical, the upper limit of the average cooling rate is preferably about 100° C./second for easy control of the steel sheet temperature and for reasonable facility cost. The average cooling rate is preferably 50° C./second or less, and more preferably 30° C./second or less.

After the cooling to a temperature in the range of from 550° C. or lower and 450° C. or higher, the steel sheet is held at a temperature within this range for about 1 to 200 seconds to form bainitic ferrite to thereby give an ultrahigh-strength steel sheet according to the present invention. The holding may be performed for about 100 to about 200 seconds in the case of an ultrahigh-strength steel sheet; whereas it may be performed for about 1 to about 100 seconds in the case of an ultrahigh-strength GI steel sheet or ultrahigh-strength GA steel sheet mentioned later.

After the holding, a hot-dip galvanized layer may be formed on the ultrahigh-strength steel sheet according to a common procedure to give an ultrahigh-strength GI steel sheet according to the present invention. The hot-dip galvanization may be performed at a plating bath temperature of preferably from 400° C. to 500° C. and more preferably from 440° C. to 470° C. The plating bath for use herein is not limited in composition and may be any of known hot-dip galvanization baths.

The steel sheet after hot-dip galvanization is cooled according to a common procedure to give an ultrahigh-strength GI steel sheet having a desired structure. Specifically, the steel sheet is cooled down to room temperature at an average cooling rate of 1° C./second or more to transform austenite in the steel sheet into martensite to thereby give a metal structure mainly containing martensite. Cooling, if performed at an average cooling rate of less than 1° C./second, may not allow the sufficient formation of martensite but may cause the formation of pearlite and intermediate transformation structures. The average cooling rate is preferably 5° C./second or more. Though not critical, the upper limit of the average cooling rate is preferably about 50° C./second for easy control of the steel sheet temperature and for reasonable facility cost. The average cooling rate is preferably 40° C./second or less, and more preferably 30° C./second or less.

The ultrahigh-strength GI steel sheet may be further subjected to an alloying treatment according to a common procedure to give an ultrahigh-strength GA steel sheet. Specifically, the alloying treatment may be performed by holding the steel sheet after hot-dip galvanization under the conditions at a temperature of from about 500° C. to about 600° C. (preferably from about 530° C. to about 580° C.) for a duration of from about 5 to about 30 seconds (preferably from about 10 to about 25 seconds). The alloying treatment may be performed typically using a heating furnace, direct fire, or an infrared heating furnace. The heating is also not limited in procedure and may employ a customary procedure such as gas heating or heating with an induction heater (heating with an induction heating equipment).

The steel sheet after the alloying treatment is cooled according to a common procedure to give an ultrahigh-strength GA steel sheet having a desired structure. Specifically, the steel sheet is cooled down to room temperature at an average cooling rate of 1° C./second or more to have a metal structure mainly containing martensite.

The ultrahigh-strength GI steel sheet or the ultrahigh-strength GA steel sheet may further be subjected to any of treatments such as painting treatments (coating), painting surface preparations (e.g., chemical conversion treatments such as phosphatization), and organic coating treatments (e.g., formation of organic coatings such as film lamination).

Exemplary paints (coating materials) for the painting treatments may contain any of known resins such as epoxy resins, fluorocarbon resin, acrylic silicone resins, polyurethane resins, acrylic resins, polyester resins, phenolic resins, alkyd resins, and melamine resins. Among them, epoxy resins, fluorocarbon resins, and acrylic silicone resins are preferred for satisfactory corrosion resistance. The paints may further contain curing agents in addition to the resins. The paints may further employ any of known additives such as coloring pigments, coupling agents, leveling agents, sensitizers, antioxidants, ultraviolet stabilizers, and flame retardants.

The paints for use herein may be paints of any form not limited, such as solvent-borne paints, aqueous paints, water-dispersed paints, powdery paints, and electrodeposition paints. Exemplary coating (painting) processes include, but are not limited to, dipping, coating with a roll water, spraying, curtain-flow coating (coating with a curtain flow water), and electropainting. The thickness of the coated layer (e.g., a plated layer, an organic coating, a chemical conversion coating, or a painted film) may be set according to an intended use.

The ultrahigh-strength steel sheets according to the present invention have ultrahigh strengths, exhibit excellent workability (bending workability and strength-elongation balance), and are usable in automobile high-strength parts including bumping parts such front and rear side members, and crush boxes; pillars such as center pillar reinforcing members; and body-constituting parts such as roof rail reinforcing members, side sills, floor members, and kick-up portions (or kick plates).

The present invention will be illustrated in further detail with reference to several experimental examples below. It should be noted, however, that these examples are never intended to limit the scope of the present invention; various alternations and modifications may be made without departing from the scope and spirit of the present invention and fall within the scope of the present invention.

EXAMPLES

Slabs having chemical compositions given in Tables 1 and 2 below (the remainder being iron and inevitable impurities) were heated to 1250° C., hot-rolled at a finish temperature of 900° C., acid-washed, cold-rolled to cold-rolling reductions CR (%) given in Tables 3 and 4 below, and thereby yielded cold-rolled steel sheets. The "REM" in Table 1 is a misch metal containing about 50% of La and about 30% of Ce. Tables 1 and 2 indicate the chemical compositions and the $Ac_3$ temperatures of the respective slabs, which $Ac_3$ temperatures were calculated according to Expression (i). Tables 3 and 4 indicate left-hand values (Z values) in Expression (1) as calculated based on the cold-rolling reduction CR upon cold rolling and the chemical composition of each slab.

The resulting cold-rolled steel sheets were heated at an average rate of temperature rise of 10° C./second to soaking temperatures given in Tables 3 and 4, held at the soaking temperatures for 50 seconds for soaking, cooled at an average cooling rate of 10° C./second to cooling stop temperatures given in Tables 3 and 4, and held at the cooling stop temperatures for 50 seconds or 180 seconds. Tables 3 and 4 indicate "$Ac_3$ point-10° C." (the temperature lower than the $Ac_3$ point by 10° C.) and "$Ac_3$ point+50° C." (the temperature higher than the $Ac_3$ point by 50° C.) as calculated based on the $Ac_3$ temperatures indicated in Tables 1 and 2; and holding times at the cooling stop temperature.

After the holding, some cold-rolled steel sheets were subjected to hot-dip galvanization to yield GI steel sheets (Samples Nos. 9 to 14), and others were subjected to hot-dip galvanization and then heated for an alloying treatment to yield GA steel sheets (Samples Nos. 1 to 8 and 15 to 24). Samples Nos. 25 to 33 are cold-rolled steel sheets as manufactured without the plating treatment(s).

The GI steel sheets were manufactured by, after the holding, immersing the steel sheets in a hot-dip galvanization bath at 460° C. (for about 50 seconds) for hot-dip galvanization, and cooling the steel sheets down to room temperature at an average cooling rate of 10° C./second.

The GA steel sheets were manufactured by, after the hot-dip galvanization, heating to 550° C., holding at this temperature for 20 seconds for an alloying treatment, and cooling to room temperature at an average cooling rate of 10° C./second.

Tables 3 and 4 indicate the types of plating (GI or GA). The indication "none" in these tables represents that the sample in question is a cold-rolled steel sheet without plating.

The metal structures of the prepared cold-rolled steel sheets, GI steel sheets, and GA steel sheets were observed according to the following procedure to measure the fractions of martensite and soft phases (bainitic ferrite and polygonal ferrite).

<Observation of Metal Structure>

A cross-section of a sample steel sheet perpendicular to the sheet width direction was exposed, polished, further electrolytically polished, and etched to give a specimen. The metal structure of the specimen was observed under a scanning electron microscope (SEM). The observation was performed at a position of one-fourth the thickness t. Scanning electron micrographs of the metal structure were taken, subjected to image-analysis, and the area percentages of martensite, bainitic ferrite, and polygonal ferrite were respectively measured. The observation was performed at a magnification of 4000 times in a region of 20 μm by 20 μm on three view fields, and an arithmetic mean of measured area percentages was calculated. The calculated results are indicated in Table 3 and Table 4.

The micrographs (micrographs of three view fields) of the metal structure were subjected to image analysis to measure equivalent circle diameters of grains of the soft phases (bainitic ferrite and polygonal ferrite). The standard deviation and arithmetic mean of the measured equivalent circle diameters were calculated, from which a coefficient of variation [(standard deviation)/(arithmetic mean)] was calculated. Tables 3 and 4 indicate the standard deviation, arithmetic mean, and coefficient of variation (CV) of each sample. Tables 3 and 4 also indicate, of the measured equivalent circle diameters, the minimum and maximum equivalent circle diameters.

FIG. 1 depicts a graph illustrating how the coefficient of variation in equivalent circle diameters of grains of the soft phase varies depending on the left-hand value (Z value) of Expression (1). FIG. 1 demonstrates that the control of the cold-rolling reduction CR (%) so that the Z value be 0 or more may control the soft phase to have equivalent circle diameters as measured with a coefficient of variation of 1.0 or less.

Next, the above-obtained cold-rolled steel sheets, GI steel sheets, and GA steel sheets were examined on mechanical properties and workability.

<Mechanical Properties>

A No. 5 tensile test specimen according to Japanese Industrial Standard (JIS) was sampled from a steel sheet so that the longitudinal direction of the specimen be in parallel with a direction perpendicular to the rolling direction of the steel sheet. The tensile strength (TS) and elongation (EL) of the specimen were measured according to JIS 79241. The measured results are indicated in Table 5 below. In this experimental example, a sample having a tensile strength of 1100 MPa or more was evaluated as having an "ultrahigh strength" (accepted).

<Workability>

The workability of a sample steel sheet was evaluated synthetically by (a) the product of TS and EL, and (b) the result in a bending test.

(a) The product of the tensile strength (TS) and the elongation (EL) was calculated from the measurement results of the mechanical properties and is indicated in Table 5. A sample having a product of TS and ET of 15000 MPa. % or more was evaluated as accepted (○), whereas a sample having a product of TS and EL of less than 15000 MPa. % was evaluated as rejected (x). The evaluated results are indicated in Table 5.

(b) A sample steel sheet was cut into a specimen having a size of 20 mm by 70 mm so that the longitudinal direction of the specimen be parallel with a direction perpendicular to the rolling direction of the steel sheet. Using this specimen, a 90-degree V-bending test was performed so that the bend line be parallel with the longitudinal direction. The bending test was repeated while suitably varying the bending radius R to determine a minimum bending radius $R_{min}$ at which the specimen can be bent without cracking. A sample having a minimum bending radius $R_{min}$ of 2.3t (t: gage) or less was evaluated as having satisfactory bending workability (accepted; ○), whereas a sample having a minimum bending radius $R_{min}$ of more than 2.3t (t: gage) was evaluated as having poor bending workability (rejected; x). The evaluated results are indicated in Table 5.

In this experimental example, a sample evaluated as accepted (○) in the product of TS and EL and as accepted (○) in the V-bending test was evaluated as having "excellent workability" (assessment: ○), whereas a sample evaluated as rejected (x) in at least one of the product of TS and EL and the V-bending test result was evaluated as having "poor workability" (assessment: x).

Expression (1) is modified into Expression (2) below, and the left-hand value (400×[Ti]+250×[Nb]+150×[V]-10×[Si]+10×[Mn]-10) of Expression (2) is defined as an X value. The X values of the respective samples were calculated and are indicated in Tables 3 and 4.

Figure 2:
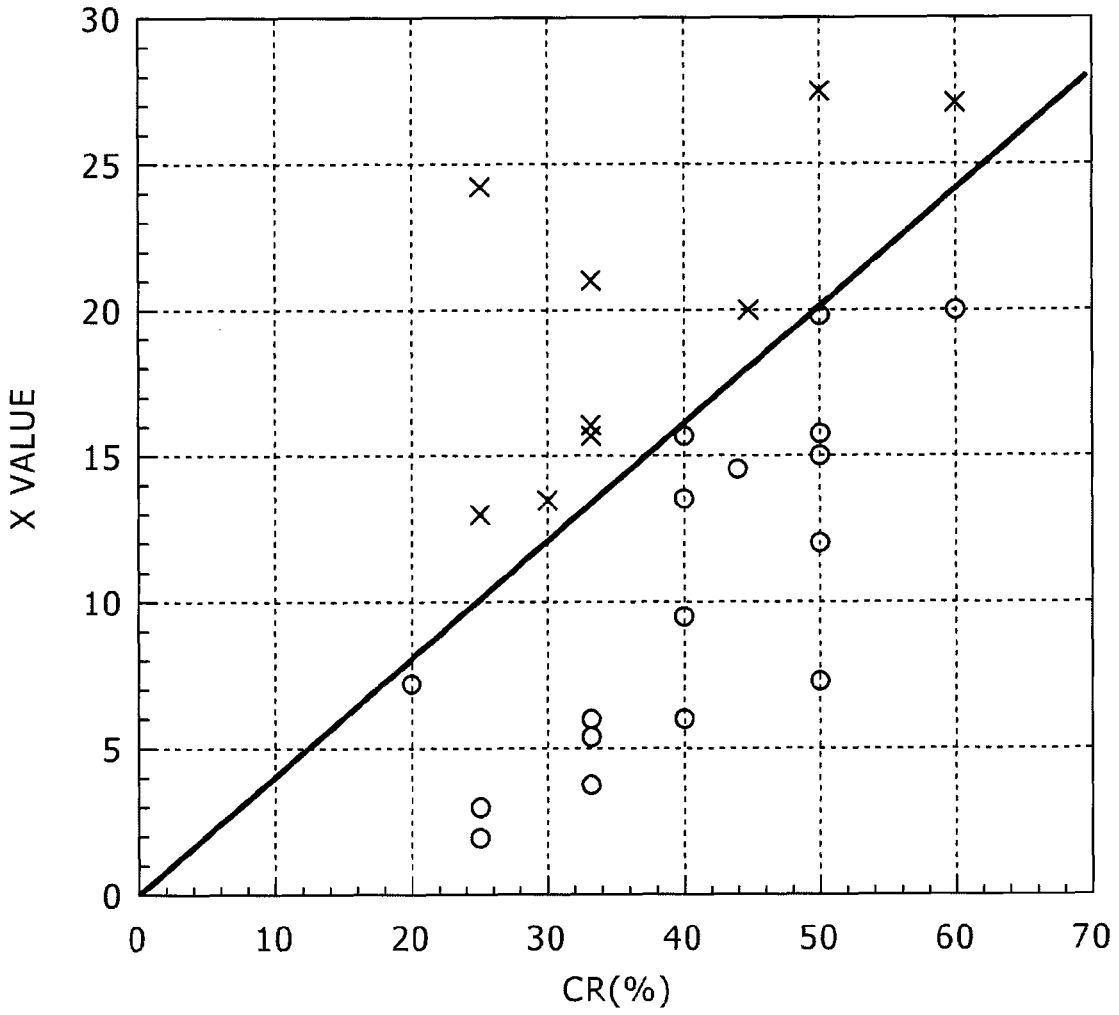
FIG. 2 is a graph illustrating how the X value (400×[Ti]+250×[Nb]+150×[V]−10×[Si]+10×[Mn]−10) varies depending on the cold-rolling reduction CR (%).

FIG. 2 illustrates how the X value varies depending on the cold-rolling reduction CR. In FIG. 2, the symbol "○" represents data of a sample having a tensile strength of 1100 MPa or more and having excellent workability, whereas the symbol "x" represents data of a sample having a tensile strength of 1100 MPa or more, but having poor workability. The straight line plotted in FIG. 2 is a line at which the X value equals 0.4CR. FIG. 2 depicts a plot of data of samples (Samples Nos. 1 to 7, 9 to 12, 15, 17, 18, 20, and 22 to 33) satisfying the conditions specified in the present invention on steel compositions and manufacturing conditions [excluding the condition relating to Expression (1)].

$$400\times[Ti]+250\times[Nb]+150\times[V]-10\times[Si]+10\times[Mn]-10\leq 0.4\times CR \quad (2)$$

FIG. 2 demonstrates that steel sheets, when having a cold-rolling reduction CR and an X value satisfying the condition specified by Expression (2), can have both a tensile strength of 1100 MPa or more and excellent workability.

Considerations from the data in Tables 1 to 5 are as follows.

Samples Nos. 2, 4, 6, 7, 9, 11, 12, 15, 17, 20, 23 to 28, 31, and 33 were samples satisfying the conditions specified in the present invention, had ultrahigh strengths in terms of tensile strength of 1100 MPa or more and exhibited excellent workability (strength-elongation balance and bending workability).

Samples Nos. 1, 3, 5, 10, 16, 18, 22, 29, 30, and 32 each had a Z value of less than 0, thereby did not satisfy the condition of Expression (1), had a coefficient of variation in equivalent circle diameter of grains of the soft phase of larger than 1.0, and failed to have improved workability.

As is described above, the coefficient of variation in equivalent circle diameters of grains of the soft phase significantly affects the bending workability and the strength-elongation balance. This can be verified typically by comparisons between Samples Nos. 2 and 3 (using Steel B or Steel C), Samples Nos. 4 and 5 (using Steel D), Samples Nos. 22 and 23 (using Steel Q), Samples Nos. 26 and 29 (using Steel T or Steel V), and Samples Nos. 31 and 32 (using Steel X or Steel Y) as indicated in Table 3. Specifically, these samples employed material steels having chemical compositions preferred in the present invention and contained metal structures with fractions satisfying the conditions specified in the present invention. Among them, samples having controlled, small coefficients of variation (Samples Nos. 2, 4, 23, 26, and 31) had desired properties (satisfactory bending workability and strength-elongation balance), but samples having large coefficients of variation (Samples Nos. 3, 5, 22, 29, and 32) were inferior in at least one of the properties. In the samples having large coefficients of variation, the Z value alone is out of the condition specified in the present invention, and this demonstrates that the control of the Z value significantly affects the control of the coefficient of variation Sample No. 8 underwent soaking at an excessively low temperature, thereby failed to form bainitic ferrite in a predetermined amount or more, and suffered from the formation of an excessively large amount of polygonal ferrite. This sample also had a large coefficient of variation in equivalent circle diameters of grains of the soft phase of more than 1.0 and failed to have improved workability.

Sample No. 13 contained Si in an excessively low content, had a large tensile strength TS but a low elongation El, and had poor strength-elongation balance. This sample also had a poor result in the V-bending test, and failed to have improved workability.

Sample No. 14 contained Mn in an excessively low content, had poor hardenability, and had a tensile strength TS of less than 1100 MPa due to a small amount of martensite and a large amount of polygonal ferrite.

Sample No. 19 underwent cooling to an excessively high cooling stop temperature, had poor strength-elongation balance due to a small amount of bainitic ferrite, and failed to have improved workability.

Sample No. 21 underwent cooling to an excessively low cooling stop temperature and had a low tensile strength TS of less than 1100 MPa due to a small amount of martensite and a large amount of bainitic ferrite.

TABLE 1

| | Chemical composition (percent by mass) | | | | | | | | | | | | | | | | $A_{C3}$ point |
|---|---|---|---|---|---|---|---|---|---|---|---|---|---|---|---|---|---|
| Steel | C | Si | Mn | P | S | Al | N | Ti | Nb | V | Cr | Cu | Ni | Mo | W | Other element | (° C.) |
| A | 0.10 | 1.2 | 3.0 | 0.010 | 0.003 | 0.03 | 0.004 | 0.01 | — | 0.01 | 0.12 | — | — | — | — | | 835 |
| B | 0.13 | 1.8 | 2.4 | 0.011 | 0.004 | 0.04 | 0.002 | 0.04 | — | — | — | — | — | 0.12 | — | REM: 0.0002 | 889 |
| C | 0.13 | 1.8 | 2.4 | 0.011 | 0.004 | 0.04 | 0.002 | 0.05 | — | — | — | — | — | 0.12 | — | | 893 |
| D | 0.13 | 1.8 | 2.4 | 0.009 | 0.002 | 0.04 | 0.004 | 0.06 | — | — | 0.20 | — | — | — | — | B: 0.0005 | 889 |
| E | 0.12 | 1.4 | 2.8 | 0.011 | 0.002 | 0.04 | 0.003 | 0.01 | — | — | 0.20 | — | — | — | — | | 846 |
| F | 0.14 | 1.2 | 2.4 | 0.011 | 0.002 | 0.05 | 0.003 | — | — | — | 0.02 | — | — | — | 0.04 | | 844 |
| G | 0.15 | 1.2 | 3.1 | 0.012 | 0.005 | 0.04 | 0.003 | 0.03 | — | — | 0.20 | — | — | — | — | | 826 |
| H | 0.15 | 1.1 | 2.4 | 0.007 | 0.004 | 0.02 | 0.003 | 0.01 | 0.03 | — | — | — | — | — | — | | 825 |
| I | 0.13 | 0.7 | 3.2 | 0.006 | 0.004 | 0.03 | 0.002 | — | — | — | — | — | — | — | — | | 788 |
| J | 0.17 | 0.1 | 2.5 | 0.005 | 0.002 | 0.04 | 0.003 | 0.01 | — | — | 0.35 | — | — | 0.11 | — | | 780 |
| K | 0.13 | 2.1 | 1.9 | 0.011 | 0.002 | 0.04 | 0.002 | — | — | 0.12 | — | — | — | — | — | | 908 |
| L | 0.19 | 2.0 | 2.1 | 0.008 | 0.003 | 0.04 | 0.004 | 0.03 | — | — | — | 0.1 | 0.1 | — | — | | 874 |
| M | 0.11 | 2.3 | 2.5 | 0.010 | 0.002 | 0.04 | 0.003 | 0.11 | — | — | — | — | — | — | — | | 936 |
| N | 0.07 | 1.3 | 3.0 | 0.012 | 0.002 | 0.04 | 0.003 | — | — | — | 0.31 | — | — | 0.07 | — | Ca: 0.001, Mg: 0.002 | 851 |
| O | 0.16 | 0.6 | 2.7 | 0.005 | 0.002 | 0.04 | 0.003 | 0.04 | — | — | 0.35 | — | — | 0.07 | — | | 808 |
| P | 0.11 | 1.7 | 3.0 | 0.011 | 0.002 | 0.04 | 0.003 | — | — | — | — | — | — | — | — | | 853 |
| Q | 0.15 | 0.7 | 3.1 | 0.011 | 0.002 | 0.04 | 0.003 | — | — | — | — | — | — | — | — | | 794 |

TABLE 2

| | Chemical composition (percent by mass) | | | | | | | | | | | | | | | | $A_{C3}$ point |
|---|---|---|---|---|---|---|---|---|---|---|---|---|---|---|---|---|---|
| Steel | C | Si | Mn | P | S | Al | N | Ti | Nb | V | Cr | Cu | Ni | Mo | W | Other element | (° C.) |
| R | 0.16 | 0.9 | 3.1 | 0.010 | 0.002 | 0.04 | 0.003 | 0.02 | — | — | 0.31 | — | — | — | — | | 805 |
| S | 0.13 | 0.8 | 2.7 | 0.012 | 0.002 | 0.04 | 0.004 | — | — | — | 0.45 | — | — | — | — | | 809 |
| T | 0.15 | 1.4 | 3.0 | 0.008 | 0.002 | 0.04 | 0.002 | — | — | — | — | — | — | — | — | | 825 |
| U | 0.09 | 1.9 | 2.6 | 0.006 | 0.002 | 0.04 | 0.003 | 0.02 | — | — | 0.42 | 0.11 | 0.09 | — | — | | 873 |
| V | 0.12 | 1.5 | 2.8 | 0.007 | 0.001 | 0.04 | 0.003 | 0.03 | — | — | 0.32 | — | — | — | — | | 849 |
| W | 0.14 | 1.5 | 2.4 | 0.007 | 0.002 | 0.04 | 0.003 | 0.02 | 0.05 | 0.05 | — | — | — | — | — | | 861 |
| X | 0.18 | 1.8 | 3.0 | 0.008 | 0.002 | 0.04 | 0.003 | — | — | — | 0.38 | — | — | — | — | | 831 |
| Y | 0.16 | 1.4 | 2.8 | 0.007 | 0.002 | 0.04 | 0.004 | 0.05 | — | — | 0.21 | — | — | 0.20 | — | | 852 |
| Z | 0.16 | 1.3 | 2.2 | 0.009 | 0.002 | 0.04 | 0.003 | 0.04 | — | — | — | — | — | — | — | | 856 |

TABLE 3

| Sample No. | Steel | X value | Cold-rolling reduction CR (%) | Z value | Soaking temperature (° C.) | ($A_{C3}$ point) −10 (° C.) | ($A_{C3}$ point) +50 (° C.) | Cooling stop temperature (° C.) | Holding time (sec.) | Plating |
|---|---|---|---|---|---|---|---|---|---|---|
| 1 | A | 13.0 | 25 | −3.0 | 850 | 825 | 885 | 500 | 50 | GA |
| 2 | B | 12.0 | 50 | 8.0 | 900 | 879 | 939 | 500 | 50 | GA |
| 3 | C | 16.0 | 33 | −2.8 | 900 | 883 | 943 | 500 | 50 | GA |
| 4 | D | 20.0 | 60 | 4.0 | 890 | 879 | 939 | 500 | 50 | GA |
| 5 | D | 20.0 | 45 | −2.0 | 890 | 879 | 939 | 500 | 50 | GA |
| 6 | E | 7.3 | 50 | 12.7 | 860 | 836 | 896 | 500 | 50 | GA |
| 7 | E | 7.3 | 20 | 0.7 | 860 | 836 | 896 | 500 | 50 | GA |
| 8 | E | 7.3 | 50 | 12.7 | 810 | 836 | 896 | 500 | 50 | GA |
| 9 | F | 2.0 | 25 | 8.0 | 840 | 834 | 894 | 500 | 50 | GI |
| 10 | G | 21.0 | 33 | −7.8 | 840 | 816 | 876 | 500 | 50 | GI |
| 11 | H | 14.5 | 44 | 3.1 | 850 | 815 | 875 | 500 | 50 | GI |
| 12 | I | 15.0 | 50 | 5.0 | 820 | 778 | 838 | 500 | 50 | GI |
| 13 | J | 17.8 | 60 | 6.2 | 820 | 770 | 830 | 500 | 50 | GI |
| 14 | K | 6.2 | 40 | 9.8 | 900 | 898 | 958 | 500 | 50 | GI |
| 15 | L | 3.8 | 33 | 9.4 | 880 | 864 | 924 | 500 | 50 | GA |
| 16 | M | 36.0 | 55 | −14.0 | 930 | 926 | 986 | 500 | 50 | GA |
| 17 | N | 6.1 | 33 | 7.1 | 860 | 841 | 901 | 500 | 50 | GA |
| 18 | O | 27.1 | 60 | −3.1 | 820 | 798 | 858 | 500 | 50 | GA |
| 19 | P | 3.0 | 25 | 7.0 | 860 | 843 | 903 | 560 | 50 | GA |
| 20 | P | 3.0 | 25 | 7.0 | 860 | 843 | 903 | 500 | 50 | GA |
| 21 | P | 3.0 | 25 | 7.0 | 860 | 843 | 903 | 420 | 50 | GA |
| 22 | Q | 13.5 | 30 | −1.5 | 840 | 784 | 844 | 500 | 50 | GA |
| 23 | Q | 13.5 | 40 | 2.5 | 840 | 784 | 844 | 500 | 50 | GA |

| | Metal structure (percent by area) | | | Soft phase | | | | |
|---|---|---|---|---|---|---|---|---|
| Sample No. | Martensite | Bainitic ferrite | Polygonal ferrite | Standard deviation | Arithmetic mean (μm) | Minimum (μm) | Maximum (μm) | CV |
| 1 | 54 | 43 | 3 | 1.5 | 1.4 | 0.2 | 3.2 | 1.1 |
| 2 | 58 | 40 | 2 | 1.1 | 1.4 | 0.2 | 2.8 | 0.8 |
| 3 | 60 | 37 | 3 | 1.2 | 1.0 | 0.1 | 2.5 | 1.2 |
| 4 | 65 | 31 | 4 | 1.1 | 1.2 | 0.1 | 2.5 | 0.9 |
| 5 | 62 | 33 | 5 | 1.2 | 0.9 | 0.1 | 2.4 | 1.3 |
| 6 | 59 | 39 | 2 | 0.9 | 1.6 | 0.2 | 3.1 | 0.6 |
| 7 | 63 | 35 | 2 | 1.1 | 1.2 | 0.1 | 2.9 | 0.9 |
| 8 | 69 | 2 | 29 | 1.7 | 1.1 | 0.1 | 5.0 | 1.6 |
| 9 | 54 | 43 | 3 | 0.8 | 1.4 | 0.3 | 2.9 | 0.6 |
| 10 | 79 | 21 | — | 1.3 | 0.9 | 0.1 | 2.7 | 1.5 |
| 11 | 57 | 43 | — | 0.9 | 1.2 | 0.1 | 2.6 | 0.8 |
| 12 | 56 | 40 | 4 | 1.1 | 1.5 | 0.2 | 3.2 | 0.7 |
| 13 | 65 | 31 | 4 | 1.1 | 1.1 | 0.2 | 3.0 | 1.0 |
| 14 | 48 | 42 | 10 | 0.8 | 1.2 | 0.1 | 2.6 | 0.7 |
| 15 | 77 | 23 | — | 1.1 | 1.4 | 0.1 | 2.8 | 0.8 |
| 16 | 52 | 45 | 3 | 1.0 | 0.7 | 0.1 | 2.4 | 1.5 |
| 17 | 75 | 24 | 1 | 1.3 | 1.4 | 0.2 | 3.0 | 0.9 |
| 18 | 73 | 24 | 3 | 1.3 | 1.1 | 0.1 | 3.1 | 1.2 |
| 19 | 85 | 11 | 4 | 1.0 | 1.3 | 0.2 | 2.7 | 0.8 |
| 20 | 77 | 19 | 4 | 1.2 | 1.5 | 0.2 | 3.2 | 0.8 |
| 21 | 27 | 69 | 4 | 1.2 | 1.5 | 0.3 | 4.2 | 0.8 |
| 22 | 71 | 29 | — | 1.4 | 1.3 | 0.1 | 2.8 | 1.1 |
| 23 | 64 | 35 | 1 | 1.3 | 1.4 | 0.2 | 3.0 | 1.0 |

TABLE 4

| Sample No. | Steel | X value | Cold-rolling reduction CR (%) | Z value | Soaking temperature (° C.) | ($A_{C3}$ point) −10 (° C.) | ($A_{C3}$ point) +50 (° C.) | Cooling stop temperature (° C.) | Holding time (sec.) | Plating |
|---|---|---|---|---|---|---|---|---|---|---|
| 24 | R | 19.8 | 50 | 0.2 | 840 | 795 | 855 | 500 | 50 | GA |
| 25 | S | 9.5 | 40 | 6.5 | 840 | 799 | 859 | 500 | 180 | none |
| 26 | T | 6.0 | 40 | 10 | 840 | 815 | 875 | 500 | 180 | none |
| 27 | U | 5.5 | 33 | 7.7 | 900 | 863 | 923 | 500 | 180 | none |
| 28 | V | 15.7 | 50 | 4.3 | 860 | 839 | 899 | 500 | 180 | none |
| 29 | V | 15.7 | 33 | −2.5 | 860 | 839 | 899 | 500 | 180 | none |
| 30 | W | 27.4 | 50 | −7.4 | 880 | 851 | 911 | 500 | 180 | none |
| 31 | X | 2.0 | 25 | 8.0 | 860 | 821 | 881 | 500 | 180 | none |
| 32 | Y | 24.2 | 25 | −14.2 | 880 | 842 | 902 | 500 | 180 | none |
| 33 | Z | 15.6 | 40 | 0.4 | 860 | 846 | 906 | 500 | 180 | none |

TABLE 4-continued

| Sample No. | Metal structure (percent by area) Martensite | Bainitic ferrite | Polygonal ferrite | Soft phase Standard deviation | Arithmetic mean (μm) | Minimum (μm) | Maximum (μm) | CV |
|---|---|---|---|---|---|---|---|---|
| 24 | 81 | 19 | — | 1.2 | 1.3 | 0.2 | 3.0 | 1.0 |
| 25 | 64 | 36 | — | 1.3 | 1.6 | 0.2 | 3.2 | 0.8 |
| 26 | 69 | 31 | — | 1.1 | 1.5 | 0.2 | 2.9 | 0.7 |
| 27 | 59 | 40 | 1 | 1.3 | 1.4 | 0.2 | 3.0 | 0.9 |
| 28 | 64 | 35 | 1 | 1.1 | 1.2 | 0.1 | 2.8 | 0.9 |
| 29 | 69 | 28 | 3 | 1.3 | 1.1 | 0.1 | 3.0 | 1.2 |
| 30 | 52 | 47 | 1 | 1.2 | 0.9 | 0.1 | 2.6 | 1.4 |
| 31 | 84 | 16 | — | 0.8 | 1.0 | 0.1 | 2.4 | 0.8 |
| 32 | 80 | 20 | — | 1.1 | 0.9 | 0.1 | 2.9 | 1.5 |
| 33 | 54 | 42 | 4 | 1.2 | 1.3 | 0.2 | 2.8 | 0.9 |

TABLE 5

| Sample No. | Mechanical properties TS (MPa) | EL (%) | Workability TS × EL (MPa %) | TS × EL evaluation | V-bending test | Assessment |
|---|---|---|---|---|---|---|
| 1 | 1164 | 12.1 | 14084 | X | X | X |
| 2 | 1201 | 13.9 | 16694 | ○ | ○ | ○ |
| 3 | 1223 | 12.1 | 14798 | X | X | X |
| 4 | 1277 | 12.1 | 15452 | ○ | ○ | ○ |
| 5 | 1320 | 10.8 | 14256 | X | X | X |
| 6 | 1223 | 13.3 | 16266 | ○ | ○ | ○ |
| 7 | 1234 | 13.2 | 16289 | ○ | ○ | ○ |
| 8 | 1315 | 12.2 | 16043 | ○ | X | X |
| 9 | 1254 | 12.5 | 15675 | ○ | ○ | ○ |
| 10 | 1359 | 10.1 | 13726 | X | X | X |
| 11 | 1304 | 11.8 | 15387 | ○ | ○ | ○ |
| 12 | 1230 | 12.5 | 15375 | ○ | ○ | ○ |
| 13 | 1225 | 9.2 | 11270 | X | X | X |
| 14 | 1082 | 15.4 | 16663 | ○ | ○ | ○ |
| 15 | 1324 | 12.1 | 16020 | ○ | ○ | ○ |
| 16 | 1256 | 11.8 | 14821 | X | X | X |
| 17 | 1173 | 13.1 | 15366 | ○ | ○ | ○ |
| 18 | 1264 | 11.6 | 14662 | X | X | X |
| 19 | 1243 | 10.9 | 13549 | X | ○ | X |
| 20 | 1176 | 13.1 | 15406 | ○ | ○ | ○ |
| 21 | 1051 | 16.1 | 16921 | ○ | ○ | ○ |
| 22 | 1318 | 11.1 | 14630 | X | X | X |
| 23 | 1287 | 12.1 | 15573 | ○ | ○ | ○ |
| 24 | 1482 | 10.6 | 15709 | ○ | ○ | ○ |
| 25 | 1243 | 12.3 | 15289 | ○ | ○ | ○ |
| 26 | 1345 | 11.8 | 15871 | ○ | ○ | ○ |
| 27 | 1194 | 14.0 | 16716 | ○ | ○ | ○ |
| 28 | 1293 | 12.2 | 15775 | ○ | ○ | ○ |
| 29 | 1303 | 11.3 | 14724 | X | X | X |
| 30 | 1198 | 11.8 | 14136 | X | X | X |
| 31 | 1502 | 10.8 | 16222 | ○ | ○ | ○ |
| 32 | 1402 | 10.2 | 14300 | X | X | X |
| 33 | 1134 | 14.6 | 16556 | ○ | ○ | ○ |

INDUSTRIAL APPLICABILITY

The present invention can provide ultrahigh-strength steel sheets, ultrahigh-strength GI steel sheets, and ultrahigh-strength GA steel sheets which have ultrahigh strengths of 1100 MPa or more and excel in workability (strength-elongation balance and bending workability).

The invention claimed is:

1. An ultrahigh-strength steel sheet, comprising, based on a total mass of the steel sheet:

from 0.05% to 0.25% of carbon (C);

from 0.5% to 2.5% of silicon (Si);

from 2.0% to 4% of manganese (Mn);

0.1% or less, excluding 0%, of phosphorus (P);

0.05% or less, excluding 0%, of sulfur (S);

from 0.01% to 0.1% of aluminum (Al);

0.01% or less, excluding 0%, of nitrogen (N); and iron (Fe), wherein the steel sheet comprises martensite; and a soft phase comprising bainitic ferrite and if any, polygonal ferrite, the steel sheet does not comprise retained austenite, the steel sheet comprises, by area percent relative to the entire steel sheet:

50 percent or more of the martensite;

15 percent or more of the bainitic ferrite;

4 percent or less of the polygonal ferrite; and a total content of 4 percent or less of other metal microstructures, the steel sheet has a coefficient of variation [(standard deviation)/(arithmetic mean)] in equivalent circle diameters of grains of the soft phase of 1.0 or less, and the steel sheet has a tensile strength of 1100 MPa or more.

2. The ultrahigh-strength steel sheet of claim 1, further comprising, at least one selected from the group consisting of:

0.10% or less, excluding 0%, of titanium (Ti);

0.2% or less, excluding 0%, of niobium (Nb); and 0.2% less, excluding 0%, of vanadium (V).

3. The ultrahigh-strength steel sheet of claim 1, further comprising, at least one selected from the group consisting of:

1% or less, excluding 0%, of chromium (Cr);

1% or less, excluding 0%, of copper (Cu); and

1% or less, excluding 0%, of nickel (Ni).

4. The ultrahigh-strength steel sheet of claim 1, further comprising, at least one selected from the group consisting of:

1% or less, excluding 0%; of molybdenum (Mo); and

1% or less, excluding 0%, of tungsten (W).

5. The ultrahigh-strength steel sheet of claim 1, further comprising:

0.005% or less, excluding 0%, of boron B.

6. The ultrahigh-strength steel sheet of claim 1, further comprising, at least one selected from the group consisting of:

0.005% or less, excluding 0%, of calcium (Ca);

0.005% or less, excluding 0%, of magnesium (Mg); and 0.005% or less, excluding 0%, of a rare earth element (REM).

7. The ultrahigh-strength steel sheet of claim 1, further comprising a hot-dip galvanized layer or a hot-dip galvannealed layer on a surface of the steel sheet.

8. The ultrahigh-strength steel sheet of claim 1, comprising, by area percent relative to the entire steel sheet:
60 percent or more of the martensite;
20 percent or more of the bainitic ferrite; and
4 percent by area or less of the polygonal ferrite.

9. The ultrahigh-strength steel sheet of claim 1, comprising, by area percent relative to the entire steel sheet:
70 percent or more of the martensite;
25 percent or more of the bainitic ferrite; and
3 percent by area or less of the polygonal ferrite.

10. The ultrahigh-strength steel sheet of claim 1, comprising, by area percent relative to the entire steel sheet:
from 70 to 85 percent of themartensite;
from 25 to 50 percent of the bainitic ferrite; and
3 percent or less of the polygonal ferrite.

11. The ultrahigh-strength steel sheet of claim 1, comprising, by area percent relative to the entire steel sheet:
from 70 to 80 percent of the martensite;
from 25 to 45 percent of the bainitic ferrite; and
0 percent of the polygonal ferrite.

12. The ultrahigh-strength steel sheet of claim having a coefficient of variation [(standard deviation)/(arithmetic mean)] in equivalent circle diameters of grains of the soft phase of 0.9 or less.

13. The ultrahigh-strength steel sheet of claim 1, having a coefficient of variation [(standard deviation)/(arithmetic mean)] in equivalent circle diameters of grains of the soft phase of 0.8 or less.

14. The ultrahigh-strength steel sheet of claim 1, comprising:
from 0.1% to 0.2% of carbon (C);
from 0.75% to 2.5% of silicon (Si);
from 2.3% to 3.5% of manganese (Mn);
0.03% or less, excluding 0%, of phosphorus (P);
0.01% or less, excluding 0%, of sulfur (S);
from 0.02% to 0.08% of aluminum (Al);
0.008% or less, excluding 0%, of nitrogen (N); and
iron (Fe).

15. The ultrahigh-strength steel sheet of claim 1, comprising:
from 0.13% to 0.18% of carbon (C);
from 1.0% to 2.0% of silicon (Si);
from 2.5% to 3.0% manganese (Mn);
0.015% or less, excluding 0%, of phosphorus (P);
0.008% or less, excluding 0%, of sulfur (S);
from 0.03% to 0.05% of aluminum (Al);
0.005% or less, excluding 0%, of nitrogen (N); and
iron (Fe).

16. The ultrahigh-strength steel sheet of claim 15, comprising, by area percent relative to the entire steel sheet:
from 70 to 85 percent of the martensite;
from 25 to 50 percent of the bainitic ferrite; and
3 percent or less of the polygonal ferrite.

17. The ultrahigh-strength steel sheet of claim 1, which consists of the martensite and a soft phase consisting of the bainitic ferrite and, if any, the polygonal ferrite.

18. A method for manufacturing the ultrahigh-strength steel sheet of claim 1, the method comprising:
(I) cold-rolling a hot-rolled steel sheet comprising, based on a total mass of the hot-rolled steel sheet:
from 0.05% to 0.25% of carbon (C);
from 0.5% to 2.5% of silicon (Si);
from 2.0% to 4% of manganese (Mn);
0.1% or less, excluding 0%, of phosphorus (P);
0.05% or less, excluding 0%, of sulfur (S);
from 0.01% to 0.1% of aluminum (Al); and
0.01% or less, excluding 0%, of nitrogen (N); and
iron (Fe),
to a cold-rolling reduction CR by percent satisfying Expression (1):

$$0.4\times CR-400\times[Ti]-250\times[Nb]-150\times[V]+10\times[Si]-10\times[Mn]+10\geq 0 \quad (1)$$

wherein [Ti], [Nb], [V], [Si], and [Mn] are the percent by mass of the respective elements;
(II) soaking the steel sheet after cold rolling at a temperature of from a temperature lower than $Ac_3$ point by 10° C. to a temperature higher than the $Ac_3$ point by 50° C. to obtain a soaked steel sheet; and
(III) cooling the soaked steel sheet down to a cooling stop temperature of 550° C. or lower and 450° C. or higher and holding the soaked steel sheet at the cooling stop temperature for 50 to 200 seconds, to obtain the ultrahigh-strength steel sheet.

19. A method for manufacturing an ultrahigh-strength hot-dip galvanized steel sheet, the method comprising:
hot-dip galvanizing the ultrahigh-strength steel sheet obtained by the method of claim 18, thereby obtaining the ultrahigh-strength hot-dip galvanized steel sheet.

20. The method of claim 19, further comprising:
subjecting the ultrahigh-strength hot-dip galvanized steel sheet to an alloying treatment.

* * * * *